US011152692B2

(12) United States Patent
Terashita et al.

(10) Patent No.: US 11,152,692 B2
(45) Date of Patent: Oct. 19, 2021

(54) ANTENNA DEVICE HAVING A CAPACITIVE LOADING ELEMENT

(71) Applicant: YOKOWO CO., LTD., Tokyo (JP)

(72) Inventors: Noritaka Terashita, Tomioka (JP); Motohisa Ono, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/549,356

(22) Filed: Aug. 23, 2019

(65) Prior Publication Data

US 2019/0379109 A1 Dec. 12, 2019

Related U.S. Application Data

(63) Continuation-in-part of application No. PCT/JP2018/006594, filed on Feb. 22, 2018.

(30) Foreign Application Priority Data

Feb. 23, 2017 (JP) ..... JP2017-031778

(51) Int. Cl.
*H01Q 1/32* (2006.01)
*H01Q 1/36* (2006.01)
(Continued)

(52) U.S. Cl.
CPC ..... *H01Q 1/3275* (2013.01); *H01Q 1/362* (2013.01); *H01Q 1/42* (2013.01); *H01Q 9/36* (2013.01); *H01Q 21/28* (2013.01)

(58) Field of Classification Search
CPC ..... H01Q 1/3275; H01Q 1/362; H01Q 1/42; H01Q 1/521; H01Q 9/36; H01Q 21/28; H01Q 21/30
See application file for complete search history.

(56) References Cited

U.S. PATENT DOCUMENTS

2009/0207084 A1* 8/2009 Ikeda ..... H01Q 5/40 343/713
2010/0265147 A1 10/2010 Wakui et al.
(Continued)

FOREIGN PATENT DOCUMENTS

CN 103094670 A 5/2013
CN 104241845 A 12/2014
(Continued)

OTHER PUBLICATIONS

International Search Report and Written Opinion dated Apr. 24, 2018 for PCT/JP2018/006594 filed on Feb. 22, 2018, 10 pages including English Translation of the International Search Report & Written Opinion.
(Continued)

*Primary Examiner* — Raymond R Chai
(74) *Attorney, Agent, or Firm* — Xsensus LLP

(57) ABSTRACT

An antenna device includes a case, a first antenna and a second antenna including a capacitance loading element. The capacitance loading element includes a turning-around area turning around in a front-rear direction on at least one of a front side and a rear side thereof. When the turning-around area is provided on the front side, at least part of the first antenna is situated in front of the turning-around area. When the turning-around area is provided on the rear side, at least part of the first antenna is situated behind the turning-around area. When the turning-around area is provided on the front side and on the rear side, at least part of the first antenna is situated at least one of in front of the turning-around area on the front side and behind the turning-around area on the rear side.

15 Claims, 10 Drawing Sheets

(51) Int. Cl.

| | |
|---|---|
| ***H01Q 1/42*** | (2006.01) |
| ***H01Q 9/36*** | (2006.01) |
| ***H01Q 21/28*** | (2006.01) |

(56) References Cited

U.S. PATENT DOCUMENTS

| | | | | |
|---|---|---|---|---|
| 2012/0026050 | A1 | 2/2012 | Sampo et al. | |
| 2012/0188143 | A1 | 7/2012 | Yang et al. | |
| 2012/0326934 | A1 | 12/2012 | Wakui et al. | |
| 2012/0326935 | A1* | 12/2012 | Kang | H01Q 11/08 343/713 |
| 2013/0176180 | A1 | 7/2013 | Wakui et al. | |
| 2013/0229315 | A1* | 9/2013 | Duzdar | H01Q 1/32 343/713 |
| 2014/0176374 | A1* | 6/2014 | Lo | H01Q 1/3275 343/713 |
| 2014/0292593 | A1* | 10/2014 | Thiam | H01Q 9/0421 343/713 |
| 2014/0340267 | A1* | 11/2014 | Kim | H01Q 1/32 343/713 |
| 2015/0236404 | A1* | 8/2015 | Choi | H01Q 5/371 343/722 |
| 2016/0064807 | A1* | 3/2016 | Reed | H01Q 1/38 343/713 |
| 2016/0104932 | A1 | 4/2016 | Aminzadeh et al. | |
| 2016/0315378 | A1* | 10/2016 | Kiriyama | H01Q 9/36 |
| 2017/0062914 | A1* | 3/2017 | Masaka | H01Q 1/1214 |
| 2017/0149123 | A1* | 5/2017 | Kim | H01Q 1/1214 |
| 2019/0393596 | A1 | 12/2019 | Mizuno et al. | |
| 2020/0067181 | A1* | 2/2020 | Tanaka | H01Q 9/40 |

FOREIGN PATENT DOCUMENTS

| | | | |
|---|---|---|---|
| CN | 106067600 | A | 11/2016 |
| JP | 2003-37422 | A | 2/2003 |
| JP | 2003-37423 | A | 2/2003 |
| JP | 2012-034226 | A | 2/2012 |
| JP | 2012-124714 | A | 6/2012 |
| JP | 2016-116048 | A | 6/2016 |
| JP | 2016-208291 | A | 12/2016 |
| JP | 6792406 | B2 | 11/2020 |

OTHER PUBLICATIONS

Office Action dated Aug. 5, 2020 in Chinese Patent Application No. 201880012694.7, 23 pages.

Office Action dated Aug. 31, 2021, in corresponding Japanese patent Application No. 2019-501818, 16 pages.

* cited by examiner

1B : ANTENNA DEVICE

ANTENNA DEVICE HAVING A CAPACITIVE LOADING ELEMENT

CROSS REFERENCE TO RELATED APPLICATIONS

This application is a Bypass Continuation-in-Part of PCT Application No. PCT/JP2018/006594, filed on Feb. 22, 2018, which claims priority to JP 2017-031778, filed Feb. 23, 2017, the entire contents of each are incorporated herein by reference.

BACKGROUND

An embodiment relates to an antenna device provided with two or more antennas in a common case.

In recent years, a vehicle-mounted antenna called a shark fin antenna has been developed. On vehicle-mounted antennas, information communication system antennas such as an ITS (Intelligent Transport System) antenna and a TEL antenna tend to be mounted in addition to a broadcasting system receiving antenna such as an AM/FM antenna (for example, Patent Literature 1).

[Patent Literature 1] JP-A-2012-124714

SUMMARY

An aspect of the embodiment is an antenna device. This antenna device is provided with: a case; and a first and a second antenna provided in the case.

The second antenna includes a capacitance loading element, the capacitance loading element includes a turning-around area turning around in a front-rear direction on at least one of a front side and a rear side thereof. When the turning-around area is provided on the front side, at least part of the first antenna is situated in front of the turning-around area of the capacitance loading element. When the turning-around area is provided on the rear side, at least part of the first antenna is situated behind the turning-around area of the capacitance loading element. And, when the turning-around area is provided on the front side and on the rear side, at least part of the first antenna is situated at least one of in front of the turning-around area on the front side of the capacitance loading element and behind the turning-around area on the rear side of the capacitance loading element.

DETAILED DESCRIPTION OF EXEMPLIFIED EMBODIMENTS

Figure 1:
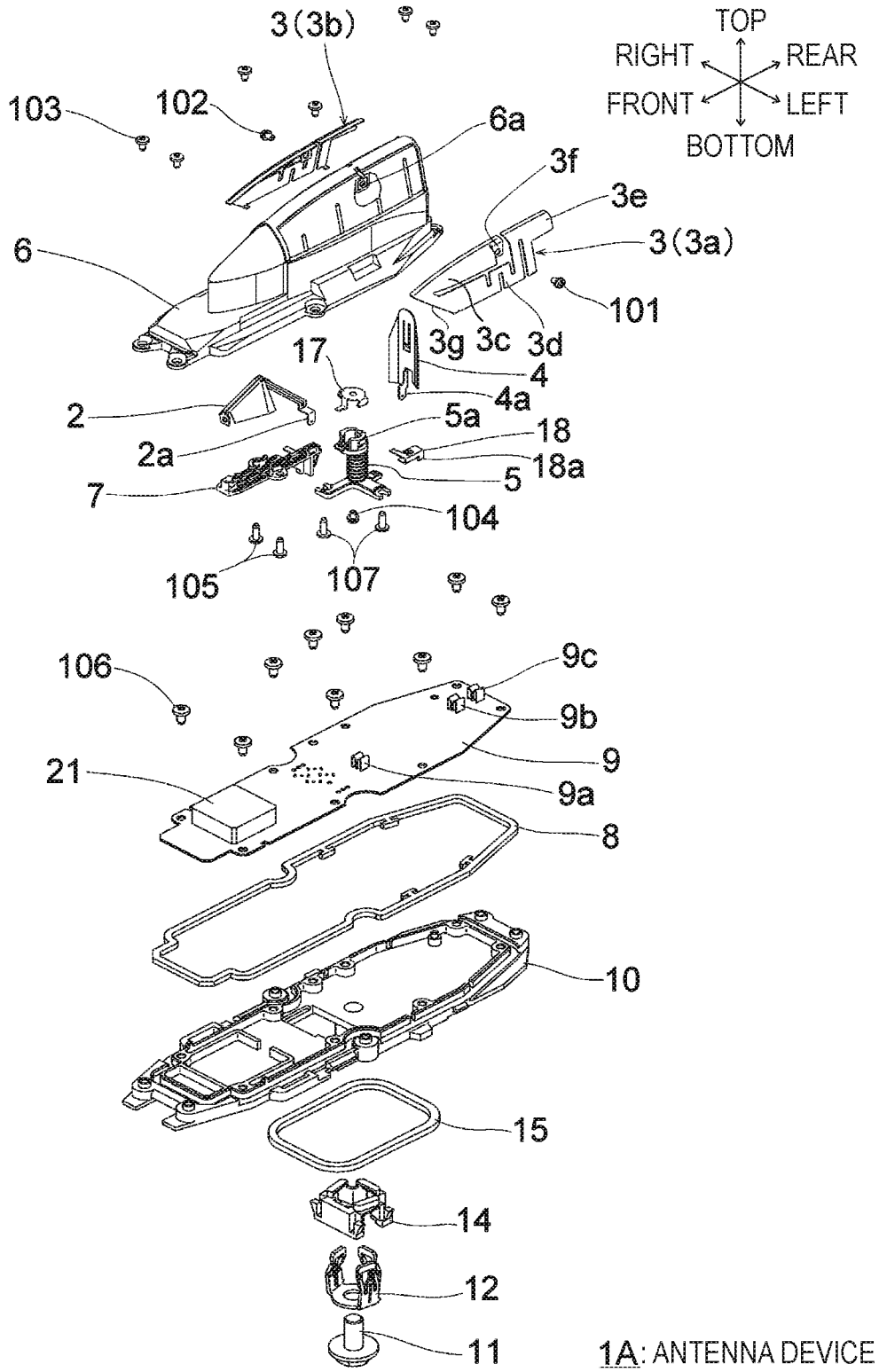
FIG. 1 is an exploded perspective view of an antenna device 1A according to a first embodiment.

Hereinafter, preferred embodiments of the embodiment will be described in detail with reference to the drawings. The same or equal components, members and the like shown in the drawings are denoted by the same reference signs, and overlapping descriptions are omitted as appropriate. The embodiments do not limit the invention and are illustrative, and all the features described in the embodiments and combinations thereof are not always essential to the invention. An aspect of the embodiment is a vehicle-mounted antenna device.

First Embodiment

Figure 2:
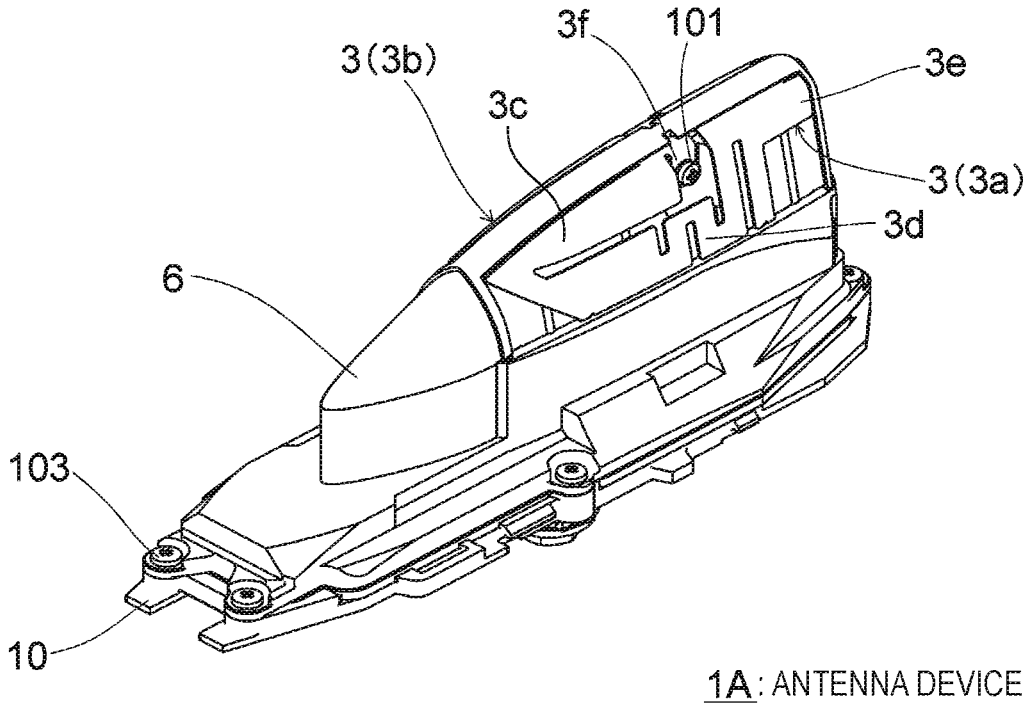
FIG. 2 is a perspective view of the antenna device 1A.

FIG. 1 is an exploded perspective view of an antenna device 1A according to a first embodiment. FIG. 2 is a perspective view of the antenna device 1A. By FIG. 1, the front-rear, top-bottom and right-left directions of the antenna device 1A are defined. The top-bottom direction is a direction vertical to the horizontal direction. The front-rear direction is the length direction of the antenna device 1A, and the right-left direction is the width direction of the antenna device 1A. Moreover, an anterior direction is the traveling direction when the antenna device 1A is attached to a vehicle, and the right-left direction is determined with reference to a condition of facing in the anterior direction which is the traveling direction.

The antenna device 1A is a vehicle-mounted shark fin antenna, and is attached to the roof or the like of a vehicle. The antenna device 1A is provided with, in a non-illustrated outer case, an ITS antenna 2 as a first antenna, a capacitance loading element 3 and a helical element (AM/FM coil) 5 as a second antenna, and a TEL antenna 4 as a third antenna. The second antenna is an AM/FM antenna, and is capable of receiving AM and FM broadcasts.

The ITS antenna 2 is an information communication system antenna for the Intelligent Transport System. The ITS antenna 2 is a plate-like component formed by processing a metal plate such as a tinned steel plate (conductive plate), and is provided in front of the capacitance loading element 3. The ITS antenna 2 has a rod-like conductor the lower end of which is a connection leg portion 2*a* and a capacitance loading element connected to the upper end of the rod-like conductor, and is disposed in the form of being inclined forward with respect to the connection leg portion 2*a*. Since the ITS antenna 2 is provided with the capacitance loading element, when the antenna size is the same, the electric length can be made long compared with when no capacitance loading element is provided. For this reason, the ITS antenna 2 is small in size compared with when no capacitance loading element is provided. Regarding the ITS antenna 2, the rod-like conductor which is a part thereof is disposed below the capacitance loading element 3. The rod-like conductor of the ITS antenna 2 is offset (shifted)

with respect to the center of a base 10 in the right-left direction. The ITS antenna 2 is electrically connected to an amplifier board 9 by the connection leg portion 2*a* being connected to a conductive plate spring 9*a* described later. Since the rod-like conductor of the ITS antenna 2 is offset, the feeding point where the connection leg portion 2*a* and the amplifier board 9 are electrically connected is also offset with respect to the center of the base 10 in the right-left direction. A holder 7 is, for example, a resin molding that holds the ITS antenna 2. By the holder 7 being attached to an inner case 6 from below by two screws 105, the ITS antenna 2 is fixed to the inner surface of the inner case 6. At the front end of the capacitance loading element of the ITS antenna 2, a hole is provided, and at the front end of the holder 7, a protrusion fitted in the hole is provided. Thereby, the ITS antenna 2 is firmly fixed to the holder 7. The frequency band of the ITS antenna 2 is, for example, 760 MHz. The inner case 6 is made of a radio wave transmitting synthetic resin (a molding made of a resin such as ABS resin). The inner case 6 is attached to the later-described base 10 by six screws 103.

The capacitance loading element 3 is a plate-like component formed by processing a plate of a metal such as a stainless steel (conductive plate). The capacitance loading element 3 has a left plate-like portion 3*a* and a right plate-like portion 3*b*, and is situated behind the ITS antenna 2 and in front of the TEL antenna 4. The capacitance loading element 3 is disposed above the base 10 with the length direction as the front-rear direction. Since the capacitance loading element 3 is divided into the left plate-like portion 3*a* and the right plate-like portion 3*b*, the floating capacity that appears with the TEL antenna 4 can be suppressed, so that the performance in the AM/FM band can be enhanced (see FIG. 3 described later).

The left plate-like portion 3*a* and the right plate-like portion 3*b* have the form of being symmetrical to each other with respect to a plane including the center of the inner case 6 in the right-left direction and parallel to the top-bottom direction and the front-rear direction. While the shape of the left plate-like portion 3*a* will be mainly described below, a similar description holds for the right plate-like portion 3*b*. The left plate-like portion 3*a* has a connection portion 3*f* parallel to the top-bottom direction and the front-rear direction, and is attached (fixed) to an upper part of the inner case 6 from the left by a screw 101 passing through the connection portion 3*f*. Likewise, the right plate-like portion 3*b* is attached (fixed) to an upper part of the inner case 6 from the right by a screw 102. On the inner case 6, a connection fitting 6*a* that is in face-to-face contact with the connection portion 3*f* is provided integrally with the inner case 6 by integral molding or the like. By the connection fitting 6*a*, the left plate-like portion 3*a* and the right plate-like portion 3*b* are coupled in the right-left direction and electrically connected together. Moreover, on the inner case 6, a rib convex to the outside is provided along the outer periphery, and the left plate-like portion 3*a* and the right plate-like portion 3*b* are attached (fixed) to the inner case 6 while being in contact with this rib. For this reason, the area where the left plate-like portion 3*a* and the right plate-like portion 3*b* are in contact with the inner case 6 is small compared with when no rib is provided, and even if the left plate-like portion 3*a* and the right plate-like portion 3*b* vibrate due to vibrations of the antenna device 1A, abnormal noise caused by contact to the inner case 6 can be suppressed.

The left plate-like portion 3*a* has a first meandering portion 3*c* which is an area including a turning-around part turning around in a first direction. For example, the first meandering portion 3*c* is an area including the turning-around part turning around in the first direction with the first direction being the front-rear direction. More specifically, the first meandering portion 3*c* has a first extending portion extending from the rear to the front from a starting point being the front of the connection portion 3*f*, a coupling portion connecting with the first extending portion and extending in a second direction (top-bottom direction) different from the first direction, and a second extending portion connecting with the coupling portion and extending from the front to the rear. An area including a turning-around part turning around in the front-rear direction like the first meandering portion 3*c* is expressed as lateral meandering portion. Because of the first meandering portion 3*c*, the current path of the left plate-like portion 3*a* extends forward with the connection portion 3*f* as one end and then, turns around rearward to reach a later-described rear extending portion 3*e* as the other end. For this reason, compared with when no first meandering portion 3*c* is formed, the current path is longer in a frequency band of a shorter wavelength. When the first meandering portion 3*c* is absent, the front end portion and the rear end portion of the left plate-like portion 3*a* are the end portions of the current path of the left plate-like portion 3*a*. However, when the first meandering portion 3*c* is present, one end of the current path of the left plate-like portion 3*a* is shifted from the front end portion (the end portion on the side of the ITS antenna 2) of the left plate-like portion 3*a* to the connection portion 3*f* (accurately, the end portion on the opposite side of the rear extending portion 3*e* in the end portion of the connection portion 3*f* in the front-rear direction). Moreover, when the first meandering portion 3*c* is absent, the front end portion and the rear end portion of the left plate-like portion 3*a* are each the voltage maximum point of the standing wave in the frequency band of the ITS antenna 2 generated at the left plate-like portion 3*a*. However, when the first meandering portion 3*c* is present, the voltage maximum point of the standing wave in the frequency band of the ITS antenna 2 generated at the left plate-like portion 3*a* is shifted from the front end portion (the end on the side of the ITS antenna 2) of the left plate-like portion 3*a* to the connection portion 3*f* (accurately, the end portion on the opposite side of the rear extending portion 3*e* in the end portion of the connection portion 3*f* in the front-rear direction). Thereby, even if the ITS antenna 2 is close to the capacitance loading element 3, the influence of the capacitance loading element 3 on the ITS antenna 2 can be reduced, so that the antenna gain of the ITS antenna 2 can be inhibited from being deteriorated with respect to the antenna gain of the ITS antenna 2 alone.

The left plate-like portion 3*a* has a second meandering portion 3*d* between the first meandering portion 3*c* and the rear extending portion 3*e*. The second meandering portion 3*d* is connected to the first meandering portion 3*c*, and is an area including a turning-around part turning around in the second direction different from the first direction which is the turning around direction of the first meandering portion 3*c*. For example, the second meandering portion 3*d* is an area including the turning-around part turning around in the second direction with the second direction being the top-bottom direction. More specifically, the second meandering portion 3*d* has a first extending portion extending from below to above, a coupling portion connecting with the first extending portion and extending in the first direction (front-rear direction) different from the second direction, and a second extending portion connecting with the coupling portion and extending from above to below. An area including a turning-around part turning around in the top-bottom direction like the second meandering portion 3*d* is expressed as longitudinal meandering portion. The second meandering portion 3*d* is a part where the current path is vertically bent, and is provided for adjusting the electric length of the left plate-like portion 3*a*. By the possession of the second meandering portion 3*d*, the electric length of the left plate-like portion 3*a* is adjusted to an electric length where no resonance occurs with a desired frequency band of a GNSS antenna 21. Thereby, the interference between the capacitance loading element 3 and the GNSS antenna 21 is suppressed, so that the gain of the GNSS antenna 21 is improved. Likewise, the electric length is made a length where the capacitance loading element 3 does not resonate with desired frequencies in the ITS band and the TEL band, either. A front edge portion 3*g* (the edge facing the side of the ITS antenna 2) of the left plate-like portion 3*a* is obliquely inclined when viewed from the left (extends from a front upper side to a rear lower side in the illustrated example). By the front edge portion 3*g* being obliquely inclined, the distance between the left plate-like portion 3*a* and the ITS antenna 2 increases, so that the floating capacity is suppressed and the performance in the AM/FM band can be enhanced (see FIG. 4 described later). Even if the front edge portion 3*g* is obliquely inclined so as to extend from the front lower side toward the rear upper side when viewed from the left, the floating capacity is suppressed, so that similar effects are produced also in this case.

The left plate-like portion 3*a* has the rear extending portion 3*e* on the rear end portion (the end on the side of the TEL antenna 4). The rear extending portion 3*e* is a part that is an upper rear end of the left plate-like portion 3*a* which end is extended rearward (protruded part). By the possession of the rear extending portion 3*e*, the area of the left plate-like portion 3*a* can be made large compared with when the rear extending portion 3*e* is absent. Moreover, by the possession of the rear extending portion 3*e*, the floating capacity with the TEL antenna 4 can be suppressed compared with when the rear end of the left plate-like portion 3*a* is wholly extended to the rear end portion of the rear extending portion 3*e*, so that the gain of the AM/FM band can be improved.

The helical element 5 is formed by winding a linear conductor around a bobbin 5*a*. On an upper part of the bobbin 5*a*, a terminal portion (terminal fitting) 17 is provided. On a lower part of the bobbin 5*a*, a terminal portion (terminal fitting) 18 is provided. One end of the winding wire is electrically connected to the terminal portion 17 by soldering or the like, and the other end thereof is electrically connected to the terminal portion 18 by soldering or the like. The terminal portion 17 is attached (fixed) to the connection fitting 6*a* by a screw 104 to be electrically connected to the connection fitting 6*a*. Thereby, the capacitance loading element 3 and the helical element 5 are electrically connected together. The bobbin 5*a* is attached (fixed) to the inner surface of the inner case 6 by two screws 107, and is situated behind the ITS antenna 2 and below the capacitance loading element 3. A connection leg portion 18*a* of the terminal portion 18 is connected to a later-described conductive plate spring 9*b* to be electrically connected to the amplifier board 9. Thereby, the helical element 5 and the amplifier board 9 are electrically connected together.

The TEL antenna 4 which is a plate-like component formed by processing a metal plate (conductive plate) such as a tinned steel plate is an antenna used for telephones and preferably, is a wide-band antenna capable of transmitting and receiving the AMPS band/PCS band. The frequency of the AMPS band is in a range of 824 to 894 MHz. The frequency of the PCS band is in a range of 1850 to 1990 MHz. The TEL antenna 4 may be an antenna that transmits and receives only one of the AMPS band and the PCS band. Moreover, the TEL antenna 4 may be used for LTE. The TEL antenna 4 is situated behind the capacitance loading element 3. The TEL antenna 4 is electrically connected to the amplifier board 9 by a connection leg portion 4*a* being connected to a later-described conductive plate spring 9*c*. The TEL antenna 4 has a U-shaped hole on a flat portion vertical to the front-rear direction, and a protrusion formed by forming this hole protrudes rearward. The TEL antenna 4 is disposed so that it is substantially vertical to the base 10 by putting the protrusion of the inner case 6 on the protrusion of the TEL antenna 4. The TEL antenna 4 has a structure in which a flat surface vertical to the front-rear direction has the largest area in order to reduce the floating capacity with the capacitance loading element 3, thereby improving the gain of the AM/FM band. Moreover, on the TEL antenna 4, in addition to the flat portion vertical to the front-rear direction, a part bent with respect to the flat portion is provided on each of the right and left ends of the flat portion. By this structure, the gain of the TEL antenna 4 is improved and the bandwidth is widened. The part of the TEL antenna 4 bent with respect to the flat portion may be provided on only one side of the flat portion in the right-left direction. Further, the gain of the AM/FM band can also be improved by providing no bent part adjacent to an upper portion of the TEL antenna 4 close to the capacitance loading element 3 to obtain a form that suppresses the interference with the capacitance loading element 3. The TEL antenna 4 is situated behind the capacitance loading element 3 and the helical element 5. When viewed from the front-rear direction, the capacitance loading element 3 and the helical element 5 are situated between the TEL antenna 4 and the ITS antenna 2. This is in order to secure a distance between the TEL antenna 4 and the ITS antenna 2 since the frequency band of the TEL antenna 4 and the frequency band of the ITS antenna 2 are close to each other. Thereby, the mutual interference between the TEL antenna 4 and the ITS antenna 2 is suppressed, and the length of the antenna device 1A in the front-rear direction is short compared with when the capacitance loading element 3 and the helical element 5 are not situated between the TEL antenna 4 and the ITS antenna 2. By situating the TEL antenna 4 behind the helical element 5, the height of the TEL antenna 4 can be increased, so that the performance of the TEL antenna 4 can be enhanced.

The amplifier board 9 is attached to the base 10 by nine screws 106. On the amplifier board 9, conductive plate springs 9*a* to 9*c*, the GNSS (Global Navigation Satellite System) antenna 21, and an AM/FM/GNSS amplifier and a TEL/ITS matching circuit that are not shown are provided. A waterproof pad (watertight sealing member) 8 which is an annular elastic member of elastomer, rubber or the like is provided on the base 10. The waterproof pad 8 is pressed over the entire perimeter by the lower end portion of the inner case 6 fixed to the base 10 by screwing or the like, thereby attaining water-tightness between the base 10 and the inner case 6. A sealing member 15 is an annular elastic member of elastomer, urethane, rubber or the like. The sealing member 15 is sandwiched between the lower surface of the base 10 and the vehicle body (for example, the vehicle roof) to which the antenna device 1A is attached, thereby attaining waterproofness therebetween. Moreover, the sealing member 15 may have a structure in which a rib is provided on the surface in contact with the vehicle roof in order to enhance the water-tightness. A bolt (screw for attachment to the vehicle) 11 is screwed to the base 10 through a washer 12 and a holder 14, and fixes the antenna device 1A to the vehicle roof or the like. The base 10 is made of a metal such as aluminum, and obtain grounding with the vehicle through the washer 12.

Figure 3:
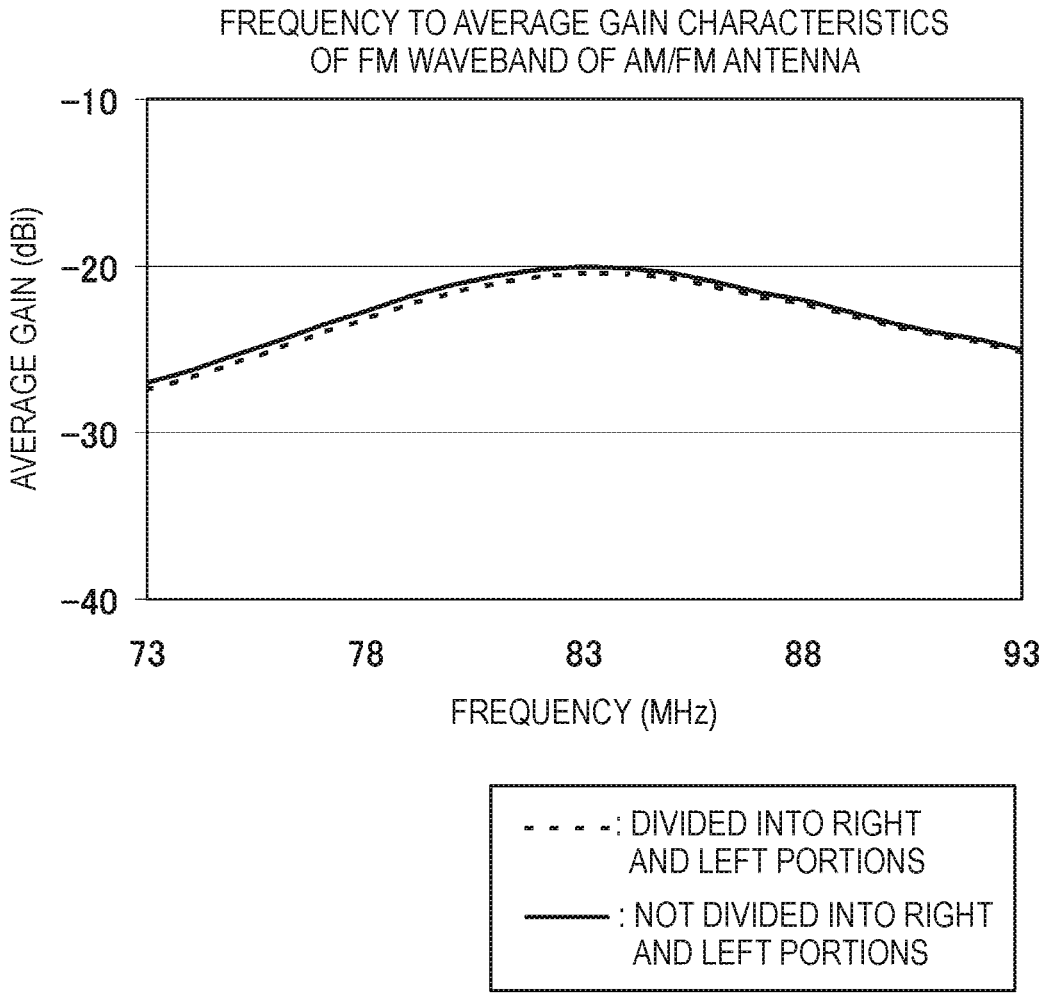
FIG. 3 is a characteristic diagram by simulation, showing the relationship between the frequency and the average gain of the FM waveband of the AM/FM antenna in each of a case where a capacitance loading element 3 is divided into a left plate-like portion 3*a* and a right plate-like portion 3*b* and a case where it is not divided.

FIG. 3 is a characteristic diagram by simulation, showing the relationship between the frequency and the average gain of the FM waveband of the AM/FM antenna in each of a case where the capacitance loading element 3 is divided into the left plate-like portion 3*a* and the right plate-like portion 3*b* and a case where the capacitance loading element 3 is not divided. Unlike FIG. 1 and FIG. 2, the two characteristics shown in FIG. 3 are both characteristics in a case where the front edges of the left plate-like portion 3*a* and the right plate-like portion 3*b* are not inclined when viewed from the right-left direction and the rear extending portion 3*e* is absent. From FIG. 3, by dividing the capacitance loading element 3 into the left plate-like portion 3*a* and the right plate-like portion 3*b*, the average gain of the FM waveband of the AM/FM antenna can be improved.

Figure 4:
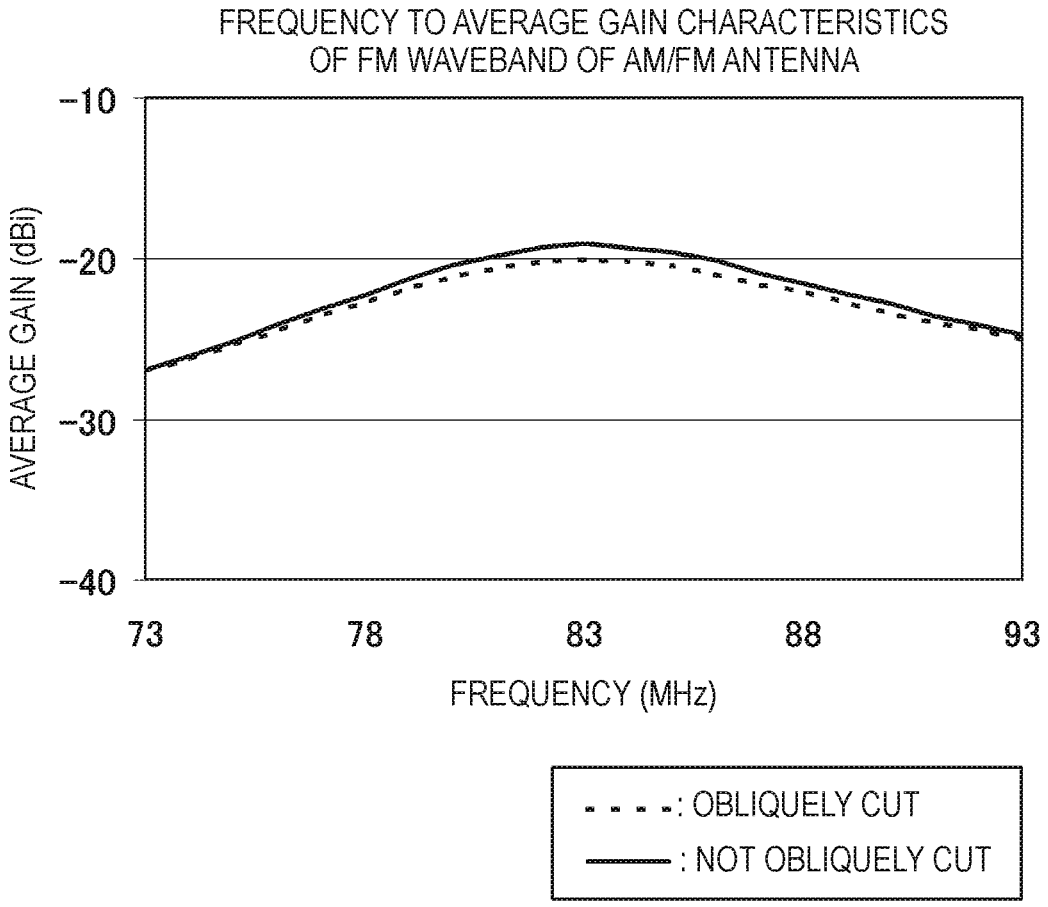
FIG. 4 is a characteristic diagram by simulation, showing the relationship between the frequency and the average gain of the FM waveband of the AM/FM antenna in each of a case where front edge portions 3*g* of the left plate-like portion 3*a* and the right plate-like portion 3*b* of the capacitance loading element 3 are obliquely inclined when viewed from a right-left direction and a case where they are not obliquely inclined.

FIG. 4 is a characteristic diagram by simulation, showing the relationship between the frequency and the average gain of the FM waveband of the AM/FM antenna in each of a case where the front edge portions 3*g* of the left plate-like portion 3*a* and the right plate-like portion 3*b* of the capacitance loading element 3 are obliquely inclined when viewed from the right-left direction (obliquely cut) and a case where they are not obliquely inclined (not obliquely cut). The direction of the oblique cut is a direction from the front upper side toward the rear lower side. Unlike FIG. 1 and FIG. 2, the two characteristics shown in FIG. 4 are both characteristics in a case where the rear extending portion 3*e* is absent. From FIG. 4, by inclining the front edge portions 3*g* of the left plate-like portion 3*a* and the right plate-like portion 3*b* obliquely when viewed from the right-left direction, the average gain of the FM waveband of the AM/FM antenna can be improved.

Figure 5:
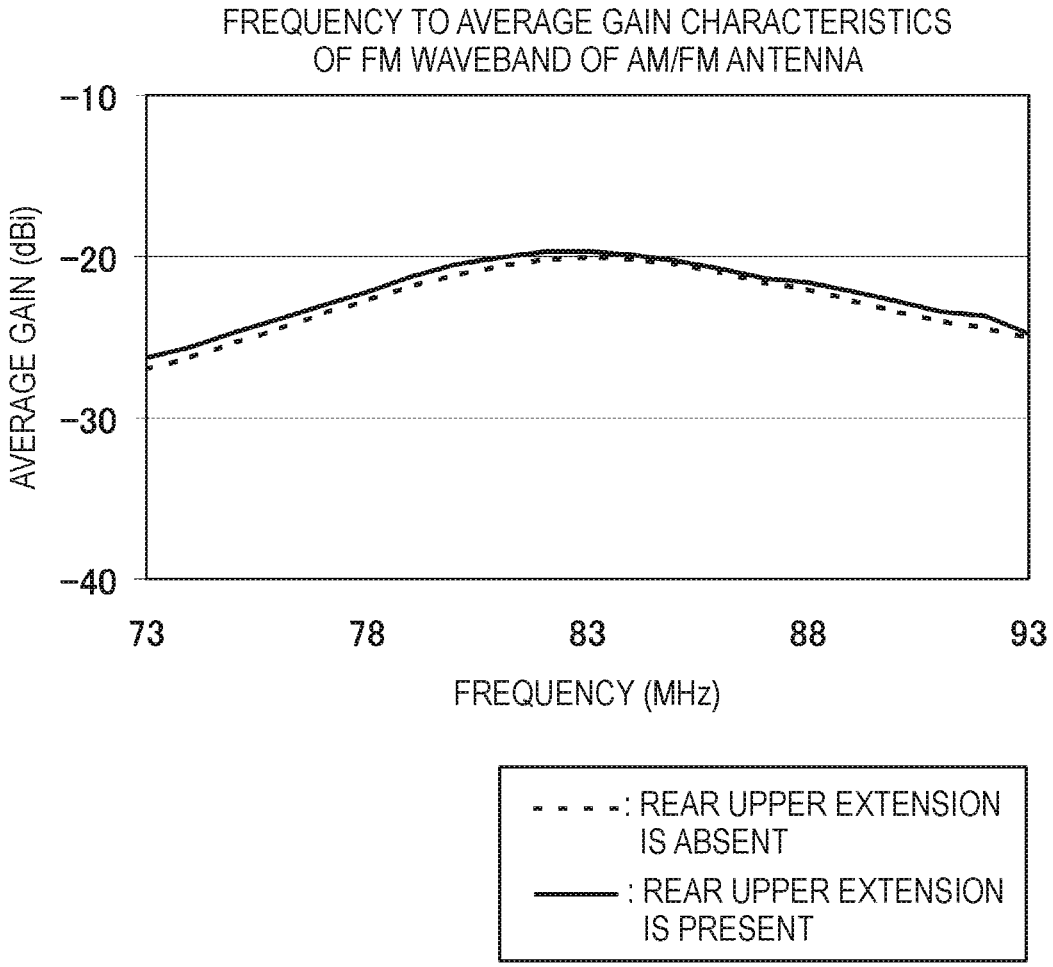
FIG. 5 is a characteristic diagram by simulation, showing the relationship between the frequency and the average gain of the FM waveband of the AM/FM antenna in each of a case where the left plate-like portion 3*a* and the right plate-like portion 3*b* of the capacitance loading element 3 have a rear extending portion 3*e* and a case where they do not have it.

FIG. 5 is a characteristic diagram by simulation, showing the relationship between the frequency and the average gain of the FM waveband of the AM/FM antenna in each of a case where the left plate-like portion 3*a* and the right plate-like portion 3*b* of the capacitance loading element 3 have the rear extending portion 3*e* and a case where the left plate-like portion 3*a* and the right plate-like portion 3*b* of the capacitance loading element 3 do not have the rear extending portion 3*e*. Unlike FIG. 1 and FIG. 2, the two characteristics shown in FIG. 5 are both characteristics in a case where the front edges of the left plate-like portion 3*a* and the right plate-like portion 3*b* are not inclined when viewed from the right-left direction. From FIG. 5, by providing the rear extending portion 3*e* on the left plate-like portion 3*a* and the right plate-like portion 3*b*, the average gain of the FM waveband of the AM/FM antenna can be improved.

According to the present embodiment, the following effects can be produced:

(1) By the first meandering portion 3*c*, the voltage maximum point of the standing wave in the frequency band of the ITS antenna 2 is shifted from the front end portion (the end on the side of the ITS antenna 2) of the capacitance loading element 3. For this reason, even if the ITS antenna 2 is close to the capacitance loading element 3, the influence of the capacitance loading element 3 on the ITS antenna 2 can be reduced, so that the antenna gain of the ITS antenna 2 can be inhibited from being deteriorated with respect to the antenna gain of the ITS antenna 2 alone.

(2) The capacitance loading element 3 is divided into the left plate-like portion 3*a* and the right plate-like portion 3*b*. For this reason, the floating capacity that appears between the capacitance loading element 3 and the TEL antenna 4 can be suppressed, so that the performance in the AM/FM band (the average gain of the FM waveband of the AM/FM antenna) can be enhanced.

(3) The front edge portions 3*g* of the left plate-like portion 3*a* and the right plate-like portion 3*b* are obliquely inclined when viewed from the right-left direction. For this reason, the distance between the capacitance loading element 3 and the ITS antenna 2 increases, so that the floating capacity is suppressed and the performance in the AM/FM band (the average gain of the FM waveband of the AM/FM antenna) can be enhanced.

(4) The left plate-like portion 3*a* and the right plate-like portion 3*b* have the rear extending portion 3*e*. For this reason, the securement of the area of the capacitance loading element 3 and the suppression of the floating capacity between the capacitance loading element 3 and the TEL antenna 4 can be realized with balance, and the performance (the average gain of the FM waveband of the AM/FM antenna) in the AM/FM band can be enhanced.

Second Embodiment

Figure 6:
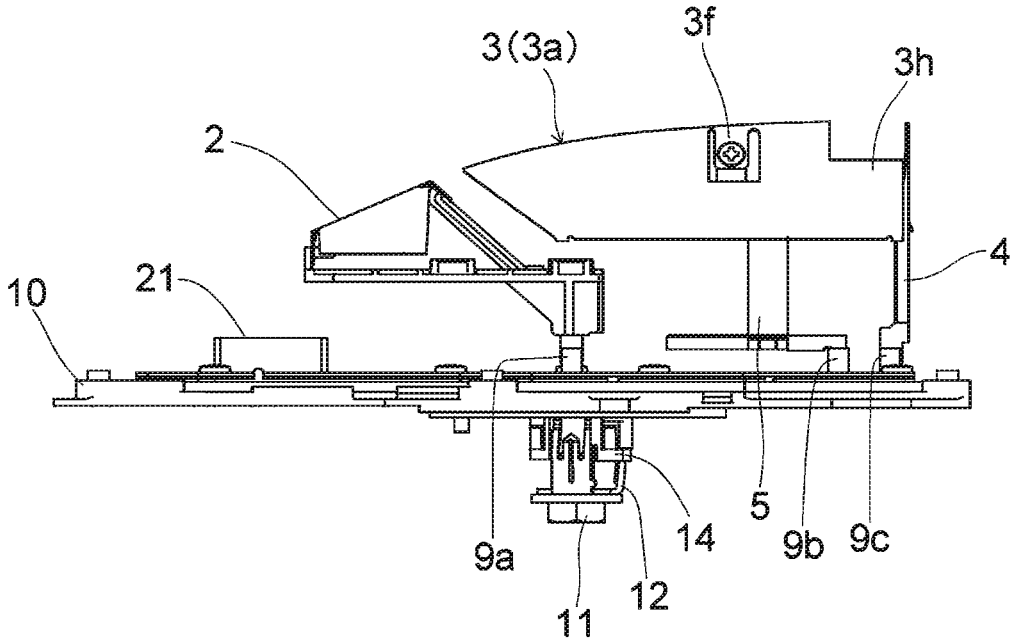
FIG. 6 is a side view of an antenna device 1B according to a second embodiment.

FIG. 6 is a side view of an antenna device 1B according to a second embodiment. Compared with the device of the first embodiment, the antenna device 1B is different in that the rear extending portion 3*e* shown in FIG. 1 and FIG. 2 is replaced by a rear extending portion 3*h* shown in FIG. 6, and is the same in the other points. The rear extending portion 3*h* is a part that is the lower rear end of the left plate-like portion 3*a* which end is extended rearward (protruded part), and is similarly provided on the right plate-like portion 3*b*. The rear extending portion 3*h* produces similar effects as the rear extending portion 3*e*. In FIG. 6, in comparison with FIG. 1 and FIG. 2, the first meandering portion 3*c* and the second meandering portion 3*d* of the left plate-like portion 3*a* and the inner case 6 are not shown. The present embodiment produces effects similarly to the first embodiment.

Third Embodiment

Figure 7:
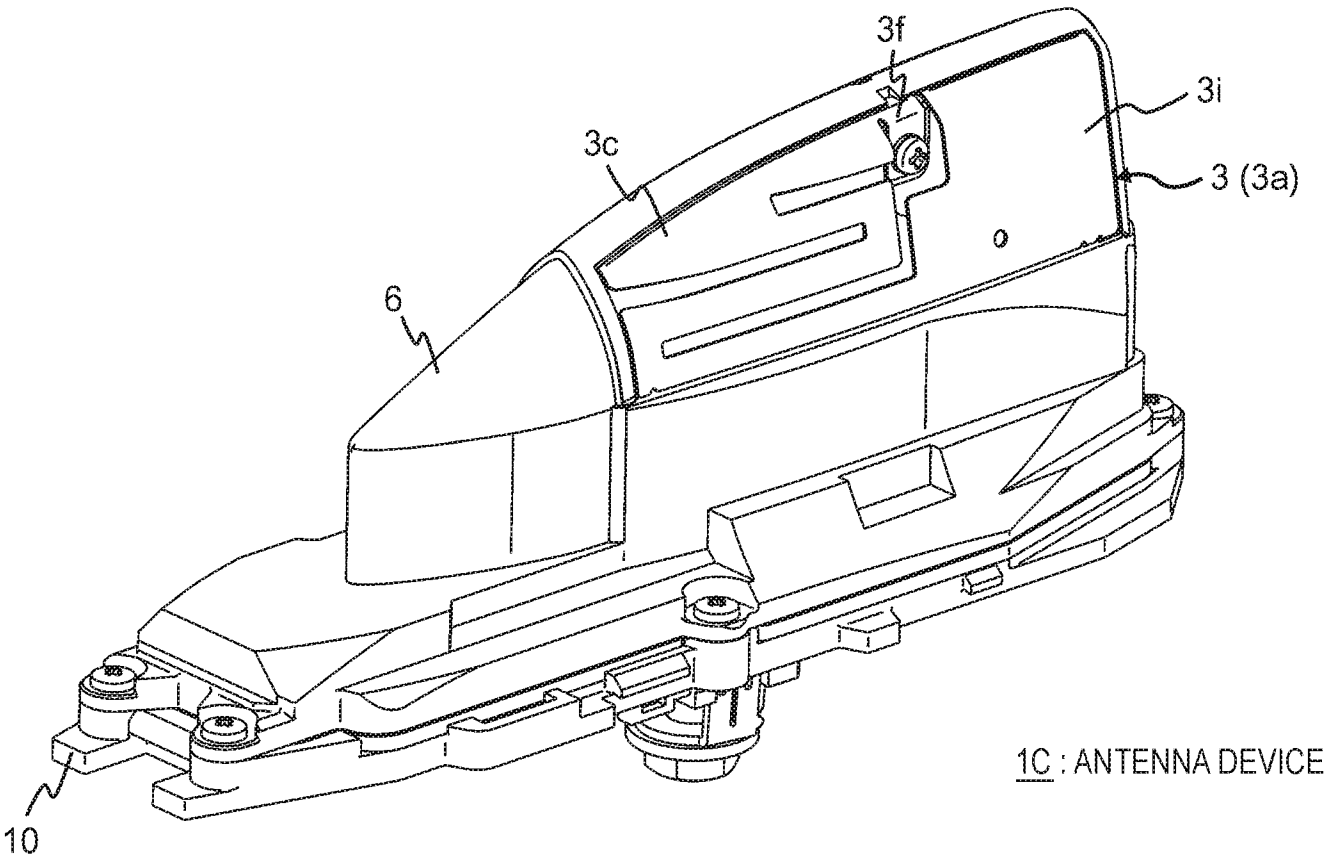
FIG. 7 is a perspective view of an antenna device 1C.

FIG. 7 is a perspective view of an antenna device 1C according to a third embodiment. Compared with the capacitance loading element 3 of the first embodiment shown in FIG. 1 and FIG. 2, the antenna device 1C is the same in that the capacitance loading element 3 is divided into the left plate-like portion 3*a* and the right plate-like portion 3*b*, that the connection fitting 6*a* in face-to-face contact with the connection portion 3*f* is provided integrally with the inner case 6 by integral molding or the like and by the connection fitting 6*a*, the left plate-like portion 3*a* and the right plate-like portion 3*b* are coupled in the right-left direction to be electrically connected together and that the first meandering portion 3*c* is provided. On the other hand, compared with the capacitance loading element 3 of the first embodiment, the antenna device 1C is different in that the capacitance loading element 3 does not have the rear extending portion 3*e* shown in FIG. 1 and FIG. 2, that the second meandering portion 3*d* shown in FIG. 1 and FIG. 2 is not provided, that the front edge portion 3*g* is not obliquely inclined and that the number of turning-around parts of the first meandering portion 3*c* is different. In the present embodiment, similarly to the first embodiment, the voltage maximum point of the standing wave in the frequency band of the ITS antenna 2 is also shifted from the front end portion (the end on the side of the ITS antenna 2) of the capacitance loading element 3 by the first meandering portion 3*c*. For this reason, even if the ITS antenna 2 is close to the capacitance loading element 3, the influence of the capacitance loading element 3 on the ITS antenna 2 can be reduced, so that the antenna gain of the ITS antenna 2 can be inhibited from being deteriorated with respect to the antenna gain of the ITS antenna 2 alone. Moreover, the capacitance loading element 3 is divided into the left plate-like portion 3*a* and the right plate-like portion 3*b*. For this reason, the floating capacity that appears between the capacitance loading element 3 and the TEL antenna 4 can be suppressed, so that the performance in the AM/FM band (the average gain of the FM waveband of the AM/FM antenna) can be enhanced.

Figure 8:
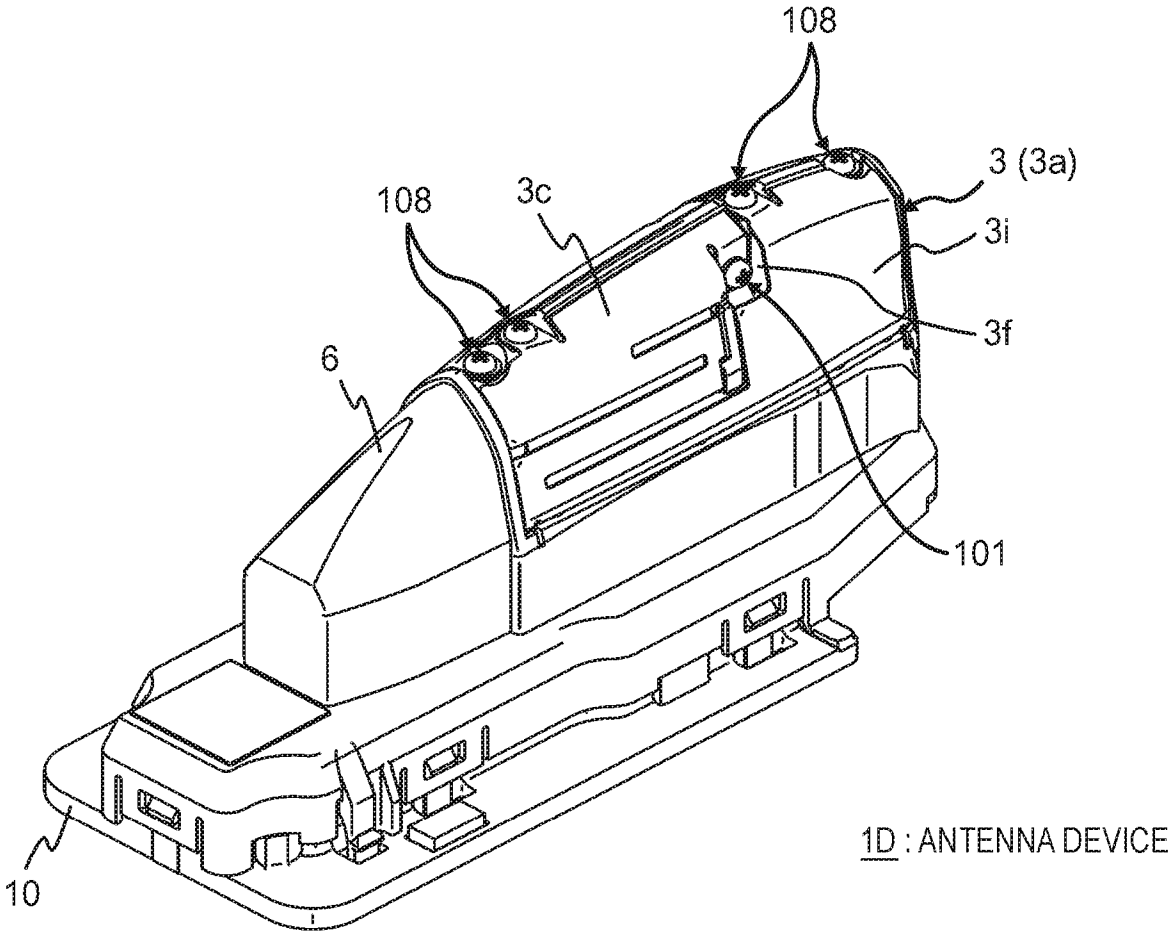
FIG. 8 is a perspective view of an antenna device 1D.

As shown in FIG. 8, in an antenna device 1D according to the embodiment, the capacitance loading element 3 may be attached to the inner case 6 not only by screws 101 from the right-left direction, but also by screws 108 from the top-bottom direction.

While the embodiments have been described, one of ordinary skill in the art would understand that the components and the processing processes of the embodiments may be modified variously within the scope of the claims. Hereinafter, modifications will be explained.

The capacitance loading element 3 is not limited to a case where it is divided into the left plate-like portion 3*a* and the right plate-like portion 3*b*, but may have a configuration in which the right and left sides are integrated with the cross section being convex to the top. The capacitance loading element 3 may be attached to the inner case 6 by welding, bonding or the like or may be held by integral molding with the inner case 6, or the like. While the capacitance loading element 3 is made of SUS (stainless steel) in point of rust prevention, a conductor sandwiched between insulating films may be made the capacitance loading element 3 and pasted to the inner case 6. The capacitance loading element 3 may be one printed on a flexible board as a conductive pattern. Further, metal powder may be evaporated to the inner case 6 to form the capacitance loading element 3.

The TEL antenna 4 may be replaced by a TV antenna, a keyless entry antenna, an inter-vehicle communication antenna or a WiFi antenna. The AM/FM antenna may be replaced by a DAB (Digital Audio Broadcast) receiving antenna. The ITS antenna 2 may be replaced by a TEL (LTE) antenna, a TV antenna, a keyless entry antenna or a WiFi antenna.

A structure may be adopted in which the TEL antenna 4 is used as the primary antenna for telephone transmission and reception and the ITS antenna 2 is used as the secondary antenna for telephone reception. In this case, the TEL antenna 4 as the primary antenna is disposed in the rear, and the ITS antenna 2 as the secondary antenna is disposed in front. For this reason, compared with when the TEL antenna 4 as the primary antenna is disposed in front and the ITS antenna 2 as the secondary antenna is disposed in the rear, the distance between the GNSS antenna 21 and the TEL antenna 4 as the primary antenna can be made long. Thereby, since the TEL antenna 4 as the primary antenna also performs telephone transmission and reception, the mutual interference between the GNSS antenna 21 and the TEL antenna 4 as the primary antenna can be suppressed.

Moreover, the antenna device according to the embodiment does not have to have the GNSS antenna 21. Moreover, in the antenna device according to the embodiment, the disposition positions of the ITS antenna 2 and the TEL antenna 4 may be switched. Moreover, the antenna device according to the embodiment does not have to have one of the ITS antenna 2 and the TEL antenna 4. That is, the antenna device according to the embodiment may have the TEL antenna 4 without having the ITS antenna 2, or may have the ITS antenna 2 without having the TEL antenna 4.

Figure 9:
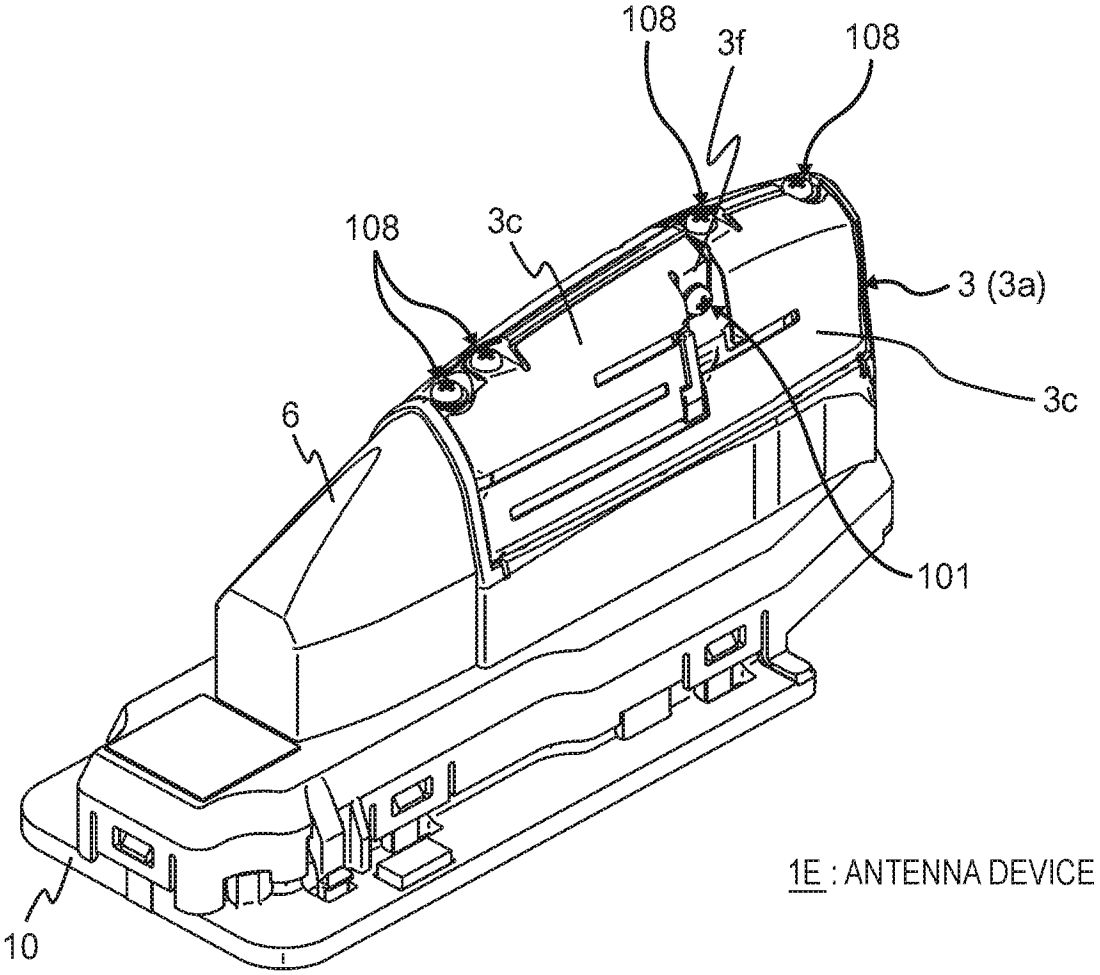
FIG. 9 is a perspective view of an antenna device 1E.

Moreover, while the antenna device according to the embodiment is described with respect to a case where the first meandering portion 3*c* is provided in front, the first meandering portion 3*c* may be provided in the rear. Moreover, as shown in FIG. 9, in an antenna device 1E according to the embodiment, the first meandering portion 3*c* may be provided both in front and in the rear.

Figure 10:
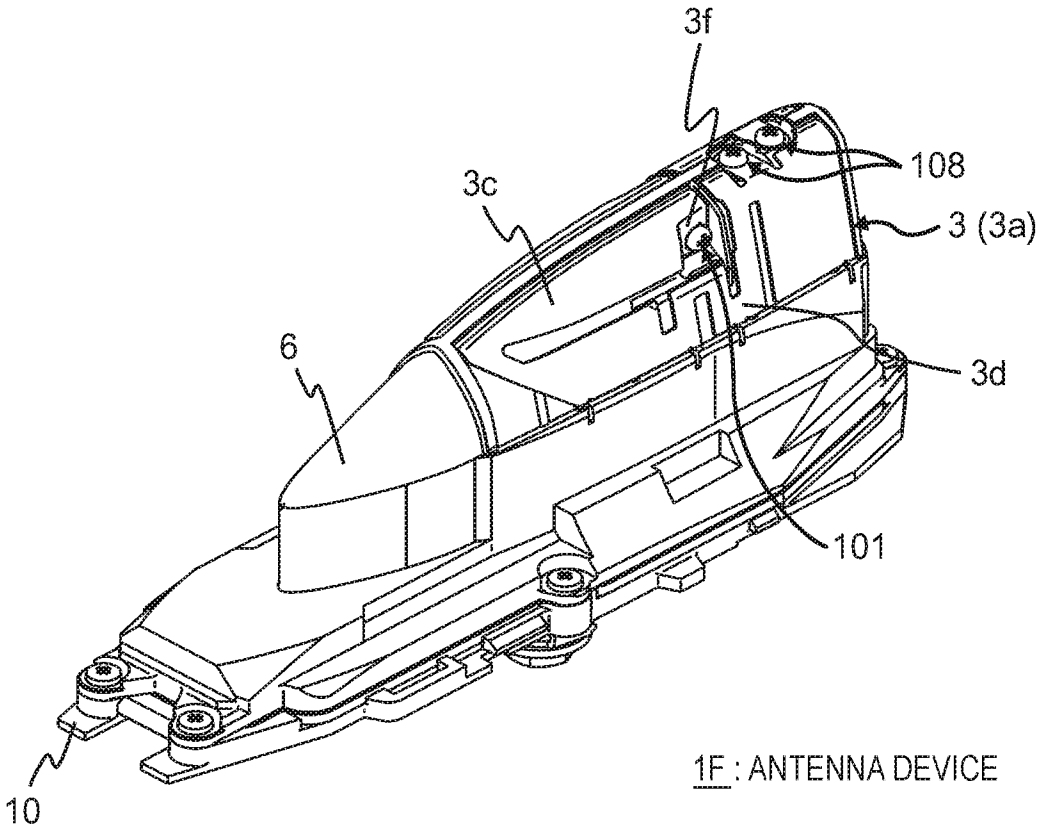
FIG. 10 is a perspective view of an antenna device 1F.

Moreover, as shown in FIG. 10, when an antenna device 1F according to the embodiment has the first meandering portion 3*c* and the second meandering portion 3*d*, the antenna device 1F does not have to have the rear extending portion 3*e*.

Moreover, while the antenna device according to the embodiment is described as a device in which the first extending portion and the second extending portion of the first meandering portion 3*c* extend parallel to the front-rear direction, at least one of the first extending portion and the second extending portion of the first meandering portion 3*c* does not have to extend parallel to the front-rear direction. That is, at least one of the first extending portion and the second extending portion of the first meandering portion 3*c* may extend so as to be inclined with respect to the front-rear direction. For example, a structure may be adopted in which the first extending portion of the first meandering portion 3*c* extends forward in a downward direction and the second extending portion of the first meandering portion 3*c* extends rearward in a downward direction. Moreover, a structure may be adopted in which the first extending portion of the first meandering portion 3*c* extends forward in a downward direction and the second extending portion of the first meandering portion 3*c* extends rearward in an upward direction. Alternatively, a structure may be adopted in which the first extending portion of the first meandering portion 3*c* extends forward in an upward direction and the second extending portion of the first meandering portion 3*c* extends rearward in a downward direction. Likewise, at least one of the first extending portion and the second extending portion of the second meandering portion 3*d* does not have to extend parallel to the top-bottom direction. That is, at least one of the first extending portion and the second extending portion of the second meandering portion 3*d* may extend so as to be inclined with respect to the top-bottom direction.

In view of the description given above, the following aspect may be made an embodiment.

An aspect of the embodiment is an antenna device. This antenna device is provided with: a case; and a first antenna and a second antenna provided in the case. The second antenna has a capacitance loading element, the capacitance loading element has a turning-around area turning around in a front-rear direction on at least one of a front side and a rear side thereof, when the turning-around area is provided on the front side, at least part of the first antenna is situated in front of the turning-around area of the capacitance loading element, when the turning-around area is provided on the rear side, at least part of the first antenna is situated behind the turning-around area of the capacitance loading element, and when the turning-around area is provided on the front side and on the rear side, at least part of the first antenna is situated at least one of in front of the turning-around area on the front side of the capacitance loading element and behind the turning-around area on the rear side of the capacitance loading element.

A structure may be adopted in which in the capacitance loading element, a voltage maximum point of a standing wave generated therein in a frequency band of the first antenna may be shifted from an end portion of the capacitance loading element on the side of the first antenna, by the turning-around area in the front-rear direction. Moreover, a structure may be adopted in which in the capacitance loading element, an end portion of a current path of the capacitance loading element may be shifted from an end portion of the capacitance loading element on the side of the first antenna by the turning-around area in the front-rear direction.

A structure may be adopted in which an inner case provided in the case is further provided, the capacitance loading element is held outside the inner case and the first antenna is held inside the inner case. Moreover, a structure may be adopted in which the second antenna has a helical element, the capacitance loading element is held outside the inner case and the helical element is held inside the inner case. The helical element may be situated behind the first antenna and below the capacitance loading element.

A structure may be adopted in which an inner case provided in the case is further provided and the capacitance loading element has a turning-around area turning around in the front-rear direction from a starting point inside the capacitance loading element. Moreover, the capacitance loading element is attached to the outside of the inner case through a connection portion provided adjacent to the starting point. An of the capacitance loading element facing the side of the first antenna is obliquely inclined when viewed from a direction vertical to a direction in which the first antenna and the second antenna are aligned and a top-bottom direction.

The capacitance loading element may have a turning-around area turning around in a top-bottom direction A structure may be adopted in which a third antenna is provided on the side opposite to the side where the first antenna is provided with respect to the capacitance loading element and in the capacitance loading element, an area thereof on the side of the third antenna is partially extended to the side of the third antenna.

A structure may be adopted in which an inner case provided in the case is further provided, the capacitance loading element has a right plate-like portion and a left plate-like portion, the right plate-like portion and the left plate-like portion are separate portions and the right plate-like portion and the left plate-like portion are held outside the inner case so that the upper end of the right plate-like portion and the upper end of the left plate-like portion are lower than the upper end of the inner case.

A structure may be adopted in which the first antenna and the second antenna are aligned in the front-rear direction, the capacitance loading element is divided in a right-left direction and at least parts of one and the other divisional portions are coupled in the right-left direction.

A structure may be adopted in which the first antenna and the second antenna are aligned in the front-rear direction and in the first antenna, the area of a flat surface vertical to the front-rear direction is the largest.

Arbitrary combinations of the above components and expressions of the embodiment changed between methods and systems are also effective as aspects of the embodiment.

According to the embodiment, an antenna device can be provided that is provided with a plurality of antennas in a common case and is capable of achieving size reduction while suppressing reduction in the antenna gain.

What is claimed is:

1. An antenna device comprising:

a case; and a first antenna and a second antenna provided in the case, wherein the second antenna includes a capacitance loading element, the capacitance loading element includes a turning-around area turning around in a front-rear direction on at least one of a front side and a rear side thereof, when the turning-around area is provided on the front side, at least part of a transmitting portion and/or a receiving portion of the first antenna is situated in front of the turning-around area of the capacitance loading element, when the turning-around area is provided on the rear side, at least part of the transmitting portion and/or the receiving portion of the first antenna is situated behind the turning-around area of the capacitance loading element, and when the turning-around area is provided on the front side and on the rear side, at least part of the transmitting portion and/or the receiving portion of the first antenna is situated at least one of in front of the turning-around area on the front side of the capacitance loading element and behind the turning-around area on the rear side of the capacitance loading element.

2. The antenna device according to claim 1, wherein in the capacitance loading element, a voltage maximum point of a standing wave generated therein in a frequency band of the first antenna is shifted from an end portion of the capacitance loading element on the side of the first antenna, by the turning-around area in the front-rear direction.

3. The antenna device according to claim 1, wherein in the capacitance loading element, an end portion of a current path of the capacitance loading element is shifted from an end portion of the capacitance loading element on the side of the first antenna, by the turning-around area in the front-rear direction.

4. The antenna device according to claim 1, further comprising:

an inner case provided in the case, wherein the capacitance loading element is held outside the inner case, and the first antenna is held inside the inner case.

5. The antenna device according to claim 1, further comprising:

an inner case provided in the case, wherein the second antenna includes a helical element, the capacitance loading element is held outside the inner case, and the helical element is held inside the inner case.

6. The antenna device according to claim 5, wherein the helical element is situated below the capacitance loading element, when the turning-around area is provided on the front side, the helical element is situated behind the first antenna, when the turning-around area is provided on the rear side, the helical element is situated in front of the first antenna, and when the turning-around area is provided on the front side and on the rear side, the helical element is situated at least one of behind the first antenna and in front of the first antenna.

7. The antenna device according to claim 1, wherein
the capacitance loading element includes a turning-around area turning around in the front-rear direction from a starting point inside the capacitance loading element.

8. The antenna device according to claim 7, further comprising:
an inner case provided in the case, wherein
the capacitance loading element is attached to an outside of the inner case through a connection portion provided adjacent to the starting point.

9. The antenna device according to claim 1, wherein
an edge of the capacitance loading element facing a side of the first antenna is obliquely inclined when viewed from a direction vertical to a direction in which the first antenna and the second antenna are aligned and a top-bottom direction.

10. The antenna device according to claim 1, wherein
the capacitance loading element has a turning-around area turning around in a top-bottom direction.

11. The antenna device according to claim 1, wherein
a third antenna is provided on a side opposite to the side where the first antenna is provided with respect to the capacitance loading element, and
in the capacitance loading element, an area of the capacitance loading element on a side of the third antenna is partially extended to the side of the third antenna.

12. The antenna device according to claim 1, further comprising:
an inner case provided in the case, wherein
the capacitance loading element includes a right plate-like portion and a left plate-like portion,
the right plate-like portion and the left plate-like portion are separate portions, and
the right plate-like portion and the left plate-like portion are held outside the inner case so that an upper end of the right plate-like portion and an upper end of the left plate-like portion are lower than an upper end of the inner case.

13. The antenna device according to claim 1, wherein
the first antenna and the second antenna are aligned in a front-rear direction, and
the capacitance loading element is divided in a right-left direction into a first portion and a second portion, and at least parts of the first and second portions are coupled.

14. The antenna device according to claim 1, wherein
the first antenna and the second antenna are aligned in a front-rear direction, and
in the first antenna, an area of a flat surface vertical to the front-rear direction is the largest.

15. The antenna device according to claim 1, wherein the capacitance loading element including a right plate-like portion and a left plate-like portion that are separate portions.

* * * * *